US006394774B1

(12) United States Patent
Kuehn et al.

(10) Patent No.: US 6,394,774 B1
(45) Date of Patent: May 28, 2002

(54) FUEL FEEDING AGGREGATE FOR AN INTERNAL COMBUSTION ENGINE

(75) Inventors: Michael Kuehn, Bietigheim-Bissingen; Dieter Schreckenberger, Marbach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/605,351

(22) Filed: Jun. 28, 2000

(30) Foreign Application Priority Data

Jul. 1, 1999 (DE) ..... 199 30 284

(51) Int. Cl.[7] ..... F04B 39/10; F04B 17/00; F02M 37/04

(52) U.S. Cl. ..... 417/559; 417/423.1; 417/423.3; 123/497

(58) Field of Search ..... 417/559, 423.1, 417/423.3; 123/497

(56) References Cited

U.S. PATENT DOCUMENTS 4,447,192 A * 5/1984 Tuckey ..... 417/360
5,039,284 A * 8/1991 Talaski ..... 417/366
5,050,567 A 9/1991 Suzuki ..... 123/514
5,574,323 A * 11/1996 Nusser ..... 310/156
5,823,169 A * 10/1998 Strohl et al. ..... 123/516
5,881,698 A * 3/1999 Tuckey et al. ..... 123/497
6,231,318 B1 * 5/2001 Cotton et al. ..... 417/423.1

FOREIGN PATENT DOCUMENTS

DE 43 31 803 A1 3/1995
DE 195 49 192 A 7/1997

* cited by examiner

*Primary Examiner*—Charles G. Freay
*Assistant Examiner*—Michael K. Gray
(74) *Attorney, Agent, or Firm*—Michael J. Striker

(57) ABSTRACT

A fuel feeding aggregate for supplying fuel to an internal combustion engine, the fuel feeding aggregate has a housing having a suction-side end and a pressure-side end, a check valve integrated in the pressure-side aid and provided for fuel supply to injection valves, and an additional check valve integrated in the suction-side end in the housing and maintaining a system pressure in the fuel feeding aggregate.

9 Claims, 3 Drawing Sheets

FUEL FEEDING AGGREGATE FOR AN INTERNAL COMBUSTION ENGINE

BACKGROUND OF THE INVENTION

The present invention relates to a fuel feeding aggregate for an internal combustion engine, such as for example electric fuel pump incorporated in a fuel supply system.

An electric motor is for example provided for driving fuel feeding aggregates for internal combustion engines. It is axially connected in alignment with a feed pump and arranged in a joint housing. This is disclosed for example in the German patent document DE 43 31 803 A1. The electric motor has a stator which is arranged in a housing and provided with two alternatingly current-supplied stator coils, in which a rotor non rotatably arranged on a housing-supported rotor shaft is rotatable. The rotor is composed of a support which is guided on the rotor shaft and a magnet segment arranged on the support over the peripheral surface. They are held on the rotor shaft by holding clamps in abutment with the support. The holding clamps are formed so that during the mounting of the individual components of the rotor, they provide centering of the magnet segments, and after the complete mounting all rotor components are clamped so that the magnet segments are held in abutment against the rotor. In the configuration disclosed in the prior art, a check valve is provided in the fuel feeding direction behind the fuel feeding aggregate.

SUMMARY OF THE INVENTION

Accordingly, it is an object of the present invention to provide a fuel feeding aggregate for internal combustion engines, which is a further improvement of the existing aggregates.

In accordance with the present invention a check valve is integrated a suction-side end in the housing of the fuel feeding aggregate and maintains a system pressure in the fuel feeding aggregate.

When the fuel feeding aggregate is designed in accordance with the present invention, it has the advantage that the check valve on the electric fuel pump maintains the feeding chamber of the fuel pump sealed relative to the tank.

The sealing of the feeding aggregate relative to the fuel tank acts so that even in the event of long stoppages no gradual idle running of the fuel supply system occurs and it remains filled from the electric fuel pump to the injection valve. Thereby the maintenance of the pressure in the fuel feeding system is prevented, which for example can lead to starting difficulties with the gas bubble formation in hot fuel.

Furthermore, with the inventive arrangement of a check valve, the pressure build up time is substantially reduced and the motor therefore can be started faster. Thereby the exhaust gas emission during the starting phase is significantly reduced.

In accordance with a preferable embodiment of the invention, the check valve is arranged on a rotatable feeding element, such as for example a feeding gear of the fuel feeding aggregate. It is therefore guaranteed that, for example, when the fuel feeding aggregate is formed as an electric fuel pump, its motor chamber can be substantially sealed from pressure losses.

In accordance with a preferable embodiment, the closing element of the check valve cooperates at the suction-side end of the fuel feeding aggregate with an abutment surface, which surrounds the feeding passage for the fuel, while the abutment surface is formed on a housing element.

The closing element of the check valve arranged at the suction-side end of the fuel feeding element can be formed in a manner which is advantageous for manufacture, as a semi-round head which can be guided on a shaft. In addition to the formation of the closing element as the semi-round head, it is also recommended to form the closing element as a spherical body. The spherical body can be enclosed in a spherical cage which forms a housing insert element.

Both the closing element formed as the semi-circular head with the guiding shaft and the ball-shaped closing body, can be formed so that a restoring force acts on them. For example a restoring spring can extend over the shaft of the semi-round head. It presses the semi-round head, with the fuel feeding aggregate stopped, against the abutment surface of the housing element and thereby closes the feeding passage. Similarly, a ball-shaped closing element in the ball cage can be subjected to the action of a spring force. The restoring spring can be supported at one side of the spherical cage, abut against a valve seat of the abutment surface, and thereby reliably close the feeding passage near the feeding element which feeds the fuel.

In accordance with an advantageous embodiment of the present invention, in a fuel feeding aggregate with a check valve integrated at a suction-side end and a pressure-side end, at the suction-side end of the fuel aggregate a check valve is provided with a spherical closing element. In this very expensive variant of a fuel feeding aggregate it is in addition guaranteed. that a pressure reduction in the pressure conduit due to a leakage in the electric fuel pump, for example at the closure cover for the conduit to the injection valve, can be avoided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
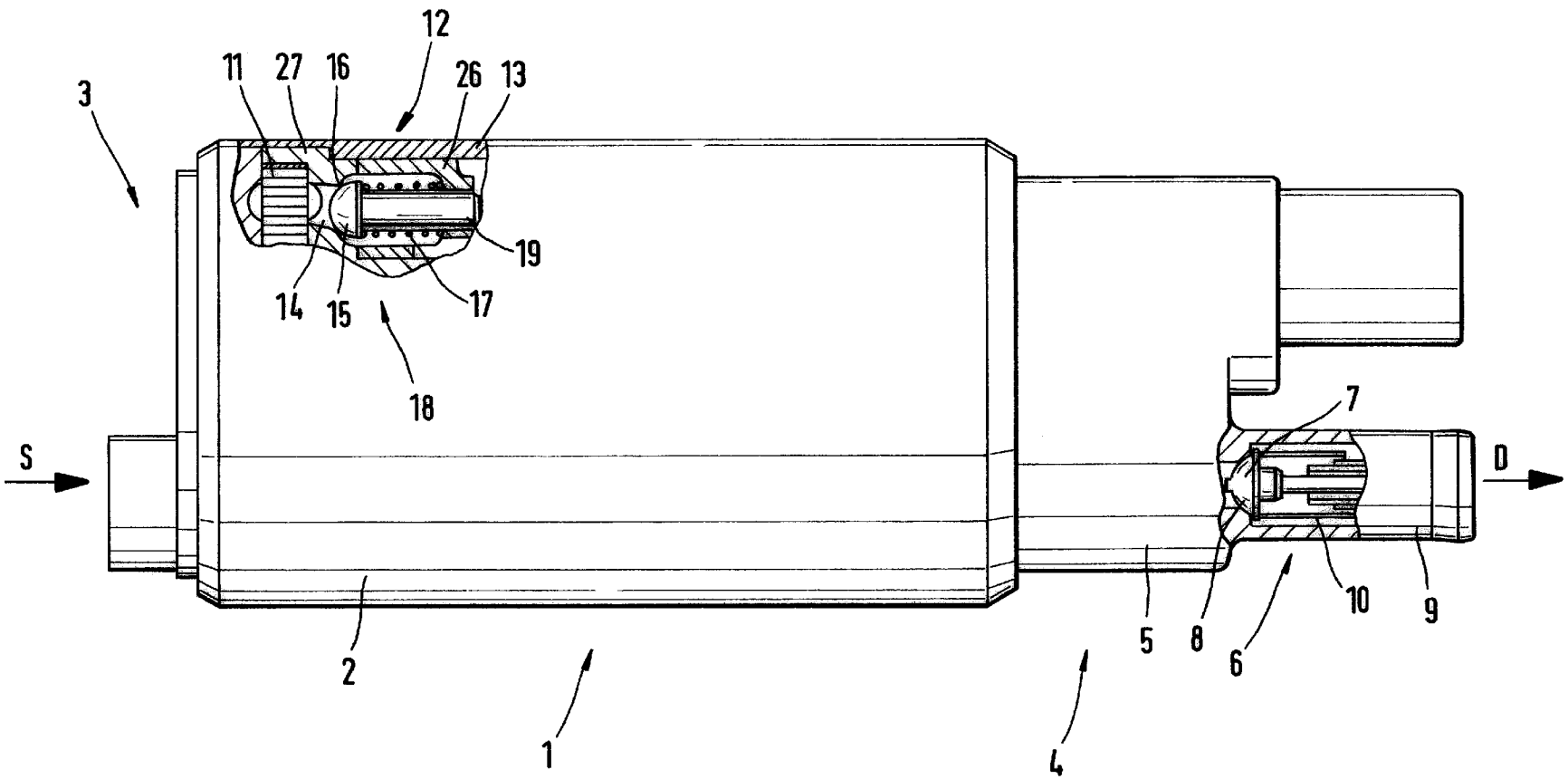
FIG. 1 is a view showing a fuel feeding aggregate with a check valve arranged at a suction-side end.

A fuel feeding aggregate with a check valve arranged at a suction-side end in accordance with the present invention is shown in Figure The fuel feeding aggregate 1 includes a housing 2 which has a suction-side end 3 and a pressure-side end 4. A conduit extends from the tank to the suction-side end 3 of the fuel feeding aggregate 1. A fuel conduit of the fuel supply system extends from the pressure-side end 4 of the fuel feeding aggregate 1 to the injection valves on the motor, which is not shown here.

A closing cover 5 is provided at the pressure-side end 4 of the fuel feeding aggregate 1. It contains a pressure-side check valve 6. It includes the closing element 7 which, for closing of the pressure-side end 4 of the fuel feeding aggregate 1 cooperates with a valve seat 8. The closing element 7 can be spring-biased by a spring element 10 and releases the fuel supply in a fuel conduit 9, with the fuel supplied to the individual injection valve which are not shown in the drawings.

A check valve 12 is provided at the suction-side end 3 of the housing 2. Also, at the suction-side end 3 of the housing 2 of the fuel feeding aggregate, a feeding element is located. In the shown embodiment of the electric fuel pump 1 it is formed as a feeding gear or impeller. The feeding gear 11 feeds the fuel which is located at the suction-side outlet of the fuel feeding aggregate 1, into a feeding passage 14. The feeding passage is closeable by means of a closing element 15 of the check valve 12 and again releasable. The closing element 15 in the embodiment shown in FIG. 1 is formed as a semi-round head and fitted on a shaft 19 which extends in the longitudinal direction. A safety element 16, 17 for example a helical spring, extends around the shaft 17. Thereby a restoring force is applied to the closing element 15. The helical spring 19 is supported with its one end at a rear part of the closing element which is formed as the semi-round head. It is supported with another end against an insert piece 26 which is inserted in the housing 2.

In the shown cutout of FIG. 1,. the semi-round head of the closing element 15 abuts against the valve seat 16 of a housing element 27 and closes the feeding passage 14 of the fuel feeding aggregate 1 at the suction-side end 3 from an undesired idle running. The surface of the valve seat 16 is adjusted to the rounding of the closing element 15 which is formed here as the semi-round head. Therefore pressure losses by leakage at the suction-side end 3 of the fuel feeding aggregate 1 are prevented.

Figure 2:
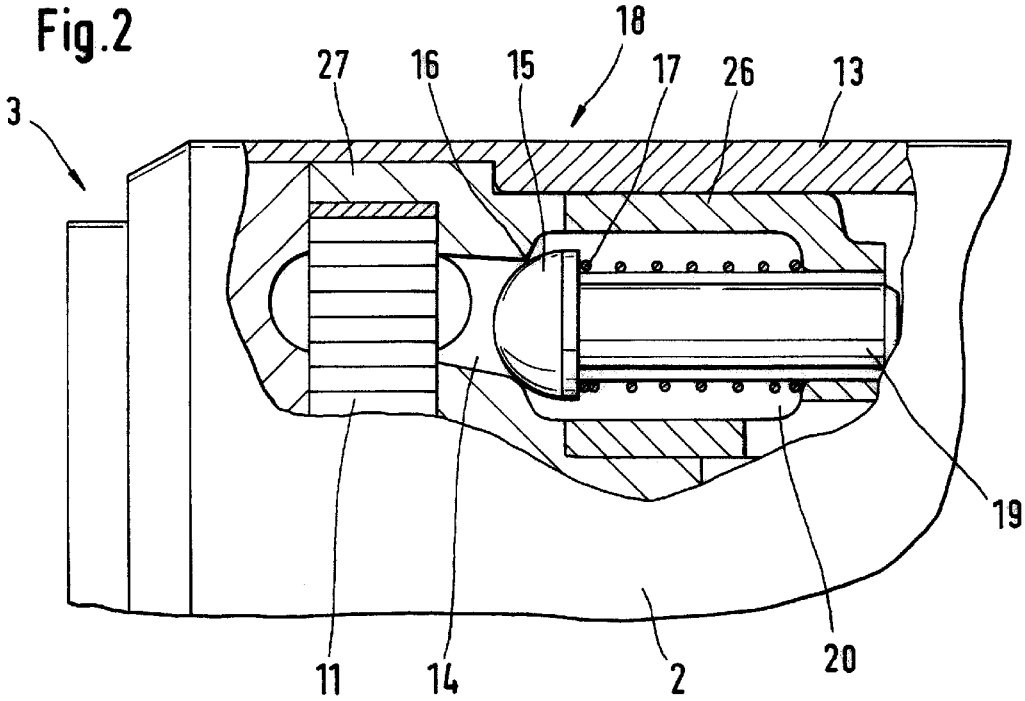
FIG. 2 is a view showing the check valve arranged at the suction-side end in a closed position.

FIG. 2 shows, on an enlarged scale, the inventive check valve 12 located at the suction-side end 3 in the closing position. In the condition shown in FIG. 2, the fuel feeding aggregate 1 is stopped. The semi-round head of the closing element 15 is pressed in the valve seat 16 and prevents an undesired outflow of the fuel from the feeding chamber 20 (in electric fuel pumps it is a motor chamber) through the feeding passage 14 at the suction-side end 3. The system pressure which acts at the turning-off point of the fuel feeding aggregate 1 in the fuel supply system acts for an activation of the closing element 15, since the pressure at the cross-sectional surface of the shaft 19 and the ring-shaped surface acts at the rear side of the closing element. The closing element 15, being supported on an optionally provided safety element 17, is pressed into the valve seat 16. Thereby the fuel supply system including the feeding chamber 20 is sealed from idle running and pressure losses at the suction-side end 3 of the fuel feeding aggregate 1. The safety element 17, for example formed as a screw spring, in the event of a failure can act as a mechanical safety element for preventing in this situation an outflow of fuel from the feeding chamber 20.

The semi-round head 15 which moves in its longitudinal direction, mechanically separates the feeding channel 14 from the feeding chamber 20 which partially extends in the hollow space of the insert member 26. Therefore, an idle running of the feeding chamber 20 is suppressed.

Figure 3:
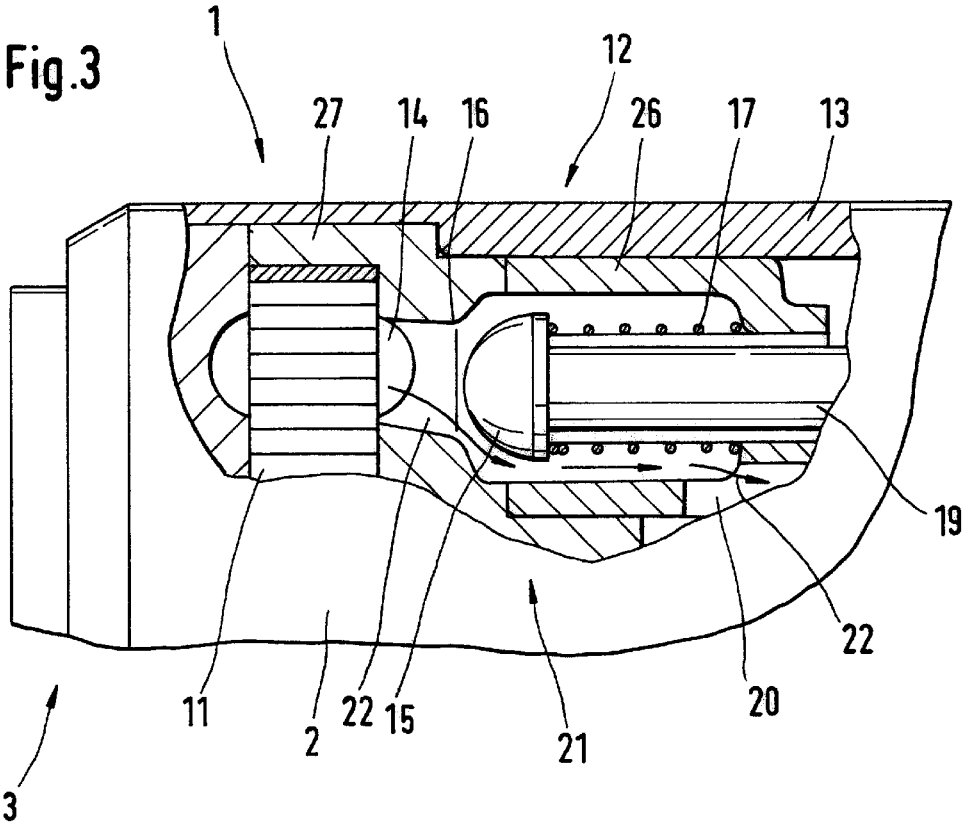
FIG. 3 is a view showing a check valve arranged at the suction-side end, in a feeding position.

FIG. 3 shows a fuel feeding aggregate 1 with the check valve 12 located at the suction-side end 3, and shown in a feeding position. After turning on of the fuel feeding aggregate 1, the feeding gear 11 feeds fuel into the feeding channel 14 at the suction-side end 3 of the housing 2. The built-up hydrostatic pressure moves the closing element 15, and the above described semi-round head or a spherical element 23 against the oppositely provided spring force, so that the system pressure is built up in the feeding chamber 20 of the fuel feeding aggregate 1. The fuel feeding is performed, and fuel acts through the passage 14 first on the hollow chamber which surrounds the shaft 19 and is formed in the insert member 26, before it enters the feeding chamber 20. Since the closing element 15 formed as the semi-round head is moved back from its valve seat 16, the fuel is supplied in the feeding direction 22 into the hollow chamber of the insert member 26 of the feeding chamber 20 arranged after it, or in other words the motor chamber of the electric fuel pump. A housing element 27 in the housing 2 is adjusted to the contour of the gear wheel 11, contains the feeding chamber 14, and operates as an abutment surface. The valve seat 16 is provided on it and its contour corresponds to the contour of the closing element 15.

Fuel is continuously supplied into the feeding chamber 20 in the feeding position 21 shown in FIG. 3. The check valve 12 at the suction-side end 3 and the check valve 6 provided at the pressure-side end 4 in the closure cover 5 are inactive. The check valves are introduced into the action during turning-off of the electric fuel pump, to maintain the system pressure in the fuel supply system and in particular to prevent an idle running of the feeding chamber 20 of the fuel feeding aggregate 1.

Figure 4:
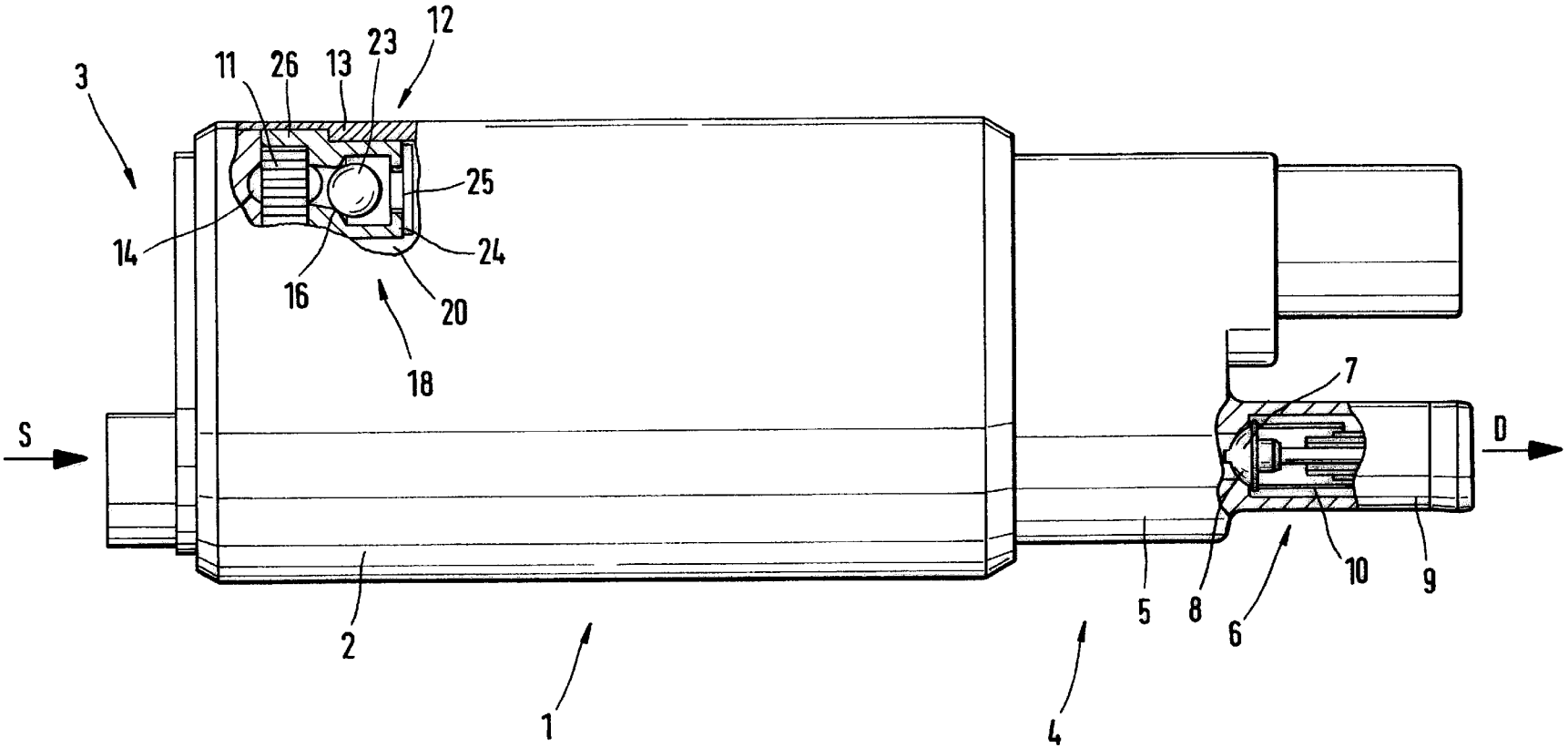
FIG. 4 is a view showing a fuel feeding aggregate with a combination of a check valve in a closing cover and a check valve with a spherical closing element at a suction-side end.

FIG. 4 shows a fuel feeding aggregate with a combination of the check valve in the closing cover and a check valve with a spherical closing element. In this expensive embodiment, the closure element 15 of the check valve 12 is formed at the suction-side end 3 of the housing 2 by a spherical body. The spherical body 23 is surrounded by a spherical cage 24 which is formed in the insert member 26 located under the housing wall 13. In the closing position 18 shown here, the spherical body 23 abuts against an abutment surface 16 of the insert member 26 and surrounds the feeding passage 14. The system pressure in the feeding chamber 20 of the fuel feeding aggregate is sufficient to press the ball 23 against the valve seat 16. The ball 23 can be pressed against the valve seat 16 by a spring which produces a restoring force. The spring in turn can be supported on a surface, preferably on a surface of the spherical cage 24 which surrounds for example the opening 25.

The combination of FIG. 4 can be used advantageously for preventing in the pressure conduit a pressure reduction due leakages on the pressure limiting valve of the electric fuel pump. For this purpose a check valve 6 can be used on the closing cover 5 in combination with a check valve 12 which has a sphere 23 as a closing element. After turning off of the electric fuel pump, the feeding passage 14 closed by the spherical body 23 prevents an idle running of the fuel aggregate 1. In addition to the above mentioned advantage, such as the shortening of the pressure build up time in the fuel supply system and the reduced emissions, the maintenance of the system pressure in the fuel supply system leads to a faster possible start of the motor with a reduced battery power since the preliminary time for building up of the system pressure is substantially shorter.

It will be understood that each of the elements described above, or two or more together, may also find a useful application in other types of constructions differing from the types described above.

While the invention has been illustrated and described as embodied in fuel feeding aggregate for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A fuel feeding aggregate for supplying fuel to injection valves of an internal combustion engine, the fuel feeding aggregate comprising a housing having a suction-side end and a pressure-side end; a check valve integrated in said pressure-side end and provided for fuel supply; and an additional check valve integrated in said suction-side end in said housing and maintaining a system pressure in the fuel feeding aggregate; pumping means fluidly connected to said additional check valve and to said first-mentioned check valve and including a feeding element provided for feeding fuel and formed as a feeding gear, said further check valve being arranged directly on said feeding gear and having a rounded closing element cooperating with an abutment surface.

2. A fuel feeding aggregate as defined in claim 1, wherein said closing element is formed as a semi-circular head.

3. A fuel feeding aggregate as defined in claim 1, wherein said closing element is formed as a ball.

4. A fuel feeding aggregate as defined in claim 1, wherein said closing element is conical.

5. A fuel feeding aggregate as defined in claim 1, wherein said closing element is cylindrical.

6. A fuel feeding aggregate as defined in claim 2, wherein said semi-spherical head has a shaft which passes through an insert.

7. A fuel feeding aggregate as defined in claim 1, wherein said closing element is acted upon with a restoring force; and further comprising means for providing said restoring force.

8. A fuel feeding aggregate as defined in claim 1; and further comprising a restoring spring which is associated with said closing element.

9. A fuel feeding aggregate as defined in claim 1, wherein said housing has a spherical cage, said closing element being spherical and surrounded by said spherical cage.

* * * * *